US012358037B2

(12) United States Patent
Ishizuka et al.

(10) Patent No.: US 12,358,037 B2
(45) Date of Patent: Jul. 15, 2025

(54) FORMING DEVICE AND FORMING METHOD

(71) Applicant: SUMITOMO HEAVY INDUSTRIES, LTD., Tokyo (JP)

(72) Inventors: Masayuki Ishizuka, Ehime (JP); Norieda Ueno, Ehime (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 254 days.

(21) Appl. No.: 17/832,279

(22) Filed: Jun. 3, 2022

(65) Prior Publication Data

US 2022/0288666 A1 Sep. 15, 2022

Related U.S. Application Data

(63) Continuation of application No. PCT/JP2021/000861, filed on Jan. 13, 2021.

(30) Foreign Application Priority Data

Mar. 2, 2020 (JP) ..... 2020-034941

(51) Int. Cl.
*B21D 26/047* (2011.01)
*B21D 37/02* (2006.01)
*B21D 37/16* (2006.01)

(52) U.S. Cl.
CPC ..... *B21D 26/047* (2013.01); *B21D 37/02* (2013.01); *B21D 37/16* (2013.01)

(58) Field of Classification Search
CPC ..... B21D 26/047; B21D 37/02; B21D 37/16; B21D 15/04; B21D 15/10; B21D 26/031
(Continued)

(56) References Cited

U.S. PATENT DOCUMENTS 6,105,409 A * 8/2000 Kojima ..... B21D 37/02 72/58
6,237,382 B1 5/2001 Kojima et al.
(Continued)

FOREIGN PATENT DOCUMENTS

DE 19 829 577 A1 1/2000
EP 0 895 820 A1 2/1999
(Continued)

OTHER PUBLICATIONS

Search Report issued in European Application No. 21764304.8, dated Jul. 18, 2023.
(Continued)

*Primary Examiner* — Adam J Eiseman
*Assistant Examiner* — Fred C Hammers
(74) *Attorney, Agent, or Firm* — Michael Best & Friedrich LLP

(57) ABSTRACT

Provided is a forming device that forms a heated metal material with a forming die, in which the forming die includes an angular portion formed by a first forming surface and a second forming surface that intersect each other in a cross-sectional view, the second forming surface is movable relative to the first forming surface, and during the forming, the second forming surface moves in a pressing direction in which the metal material is pressed in a stage before the angular portion and the metal material come into contact with each other.

7 Claims, 6 Drawing Sheets

(58) Field of Classification Search
USPC ..... 72/60
See application file for complete search history.

(56) References Cited

U.S. PATENT DOCUMENTS

| | | | | |
|---|---|---|---|---|
| 6,415,638 | B1 | 7/2002 | Sakurai et al. | |
| 11,007,839 | B2 | 5/2021 | Wada et al. | |
| 2010/0018280 | A1* | 1/2010 | Maeda | B21D 24/10 72/358 |
| 2016/0361747 | A1* | 12/2016 | Kosaka | B21D 53/88 |
| 2017/0266710 | A1* | 9/2017 | Ishizuka | B21D 26/047 |
| 2018/0161843 | A1* | 6/2018 | Saika | B21D 26/045 |
| 2018/0214923 | A1* | 8/2018 | Kolosky | B21D 37/12 |
| 2019/0344321 | A1* | 11/2019 | Nogiwa | B21D 26/047 |
| 2020/0206798 | A1* | 7/2020 | Sakamoto | B21D 13/02 |

FOREIGN PATENT DOCUMENTS

| | | | |
|---|---|---|---|
| GB | 2 455 039 | A | 6/2009 |
| JP | 2001-239329 | A | 9/2001 |
| JP | 3972006 | B2 | 9/2007 |
| JP | 2009-220141 | A | 10/2009 |
| JP | 2017-177188 | A | 10/2017 |
| JP | 6233987 | B2 | 11/2017 |
| WO | 2015097541 | A1 | 7/2015 |
| WO | 2017019855 | A1 | 2/2017 |
| WO | WO-2017/155056 | A1 | 9/2017 |
| WO | 2019003766 | A1 | 1/2019 |

OTHER PUBLICATIONS

Office Action issued in Canadian Application No. 3,162,758, dated Jul. 31, 2023.
International Search Report issued in Application No. PCT/JP2021/000861, mailed Mar. 9, 2021.

* cited by examiner

FORMING DEVICE AND FORMING METHOD

RELATED APPLICATIONS

The contents of Japanese Patent Application No. 2020-034941, and of International Patent Application No. PCT/JP2021/000861, on the basis of each of which priority benefits are claimed in an accompanying application data sheet, are in their entirety incorporated herein by reference.

BACKGROUND

Technical Field

Certain embodiments of the present invention relate to a forming device and a forming method.

Description of Related Art

In the related art, forming devices used for forming a heated metal material have been known. For example, the following related art discloses a forming device including a forming die having a lower die and an upper die paired with each other, a gas supply portion that supplies gas into a metal pipe material held between the lower die and the upper die of the forming die, and a heating unit that heats the metal pipe material by energization and heating.

SUMMARY

According to one aspect of the present invention, there is provided a forming device that forms a heated metal material with a forming die, in which the forming die includes an angular portion formed by a first forming surface and a second forming surface that intersect each other in a cross-sectional view, the second forming surface is movable relative to the first forming surface, and during the forming, the second forming surface moves in a pressing direction in which the metal material is pressed in a stage before the angular portion and the metal material come into contact with each other.

According to another aspect of the present invention, there is provided a forming method of forming a heated metal material with a forming die, in which the forming die includes an angular portion formed by a first forming surface and a second forming surface that intersect each other in a cross-sectional view, and the second forming surface is movable relative to the first forming surface. The method includes moving the second forming surface, during the forming, in a pressing direction in which the metal material is pressed in a stage before the angular portion and the metal material come into contact with each other.

According to still another aspect of the present invention, there is provided a forming device that forms a heated metal material with a forming die, in which the forming die includes an angular portion formed by a first forming surface and a second forming surface that intersect each other in a cross-sectional view, the second forming surface is movable relative to the first forming surface, and during the forming, the second forming surface is moved in a pressing direction in which the metal material is pressed, thereby forming a corner portion on the metal material, in a stage before hardening is performed by the angular portion at a spot corresponding to the corner portion of the metal material.

DETAILED DESCRIPTION

Figure 1:
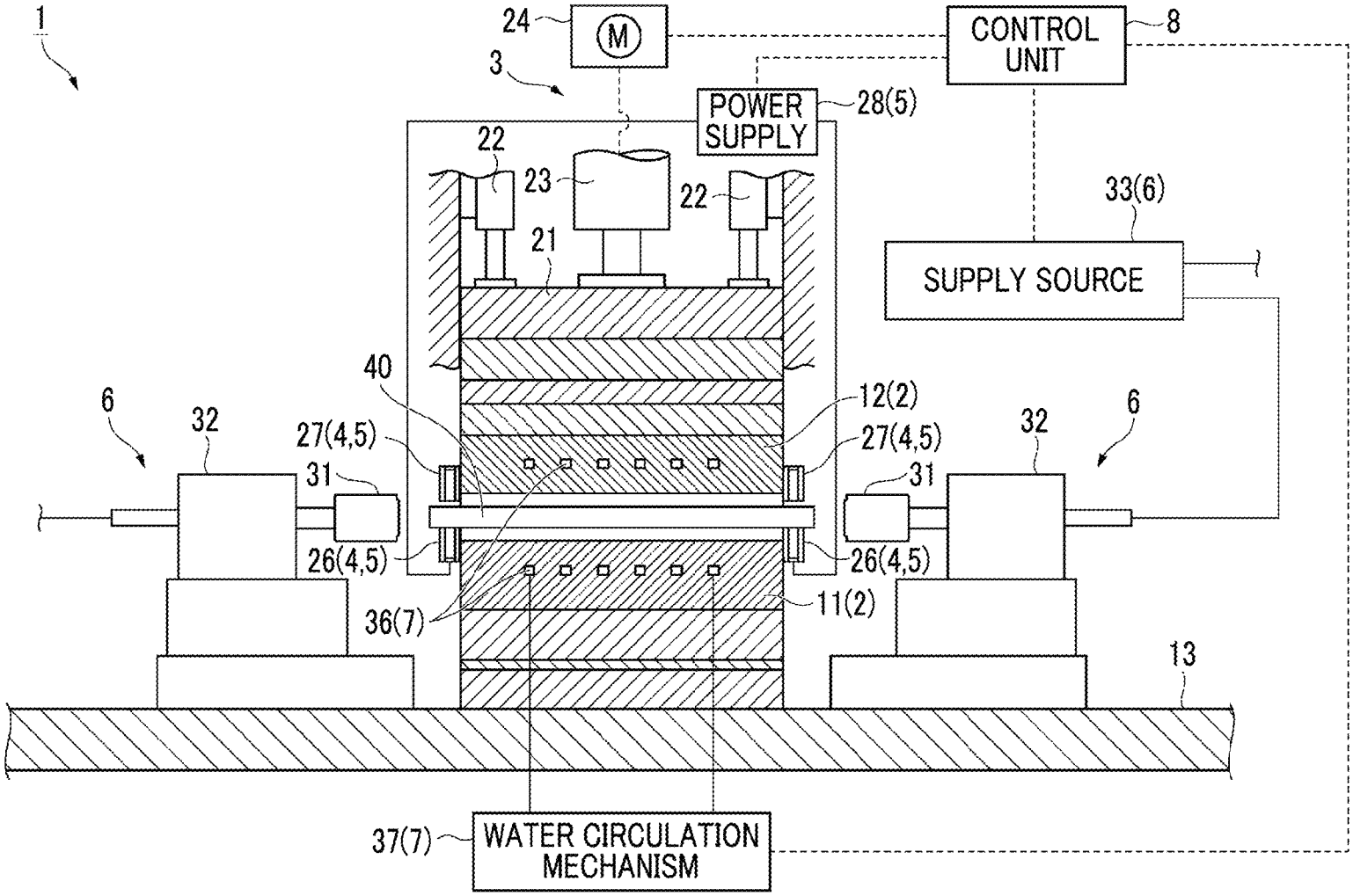
FIG. 1 is a schematic diagram of a forming device according to an embodiment of the present invention.

There is a case where the forming die of the forming device as in the above-described related art has an angular portion in order to form a corner portion of a formed product. Such angular portion is formed by forming surfaces that are perpendicular to each other. The metal material is formed into a shape corresponding to the angular portion by contacting each of the forming surfaces perpendicular to each other. However, since the size of the round diameter (corner R) of the corner portion of the formed product is substantially uniquely determined by the characteristics of the material and the forming conditions, it was difficult to reduce the diameter of the round diameter.

It is desirable to provide a forming device and a forming method capable of reducing the round diameter of a corner portion of a formed product.

The forming die of such a forming device has the angular portion formed by the first forming surface and the second forming surface that intersect each other in the cross-sectional view. Therefore, during the forming, the metal material is deformed along the angular portion of the forming die to have a shape having the corner portion. Here, the second forming surface is movable relative to the first forming surface. That is, the second forming surface, which is one surface forming the angular portion, is movable in the pressing direction in which the metal material is pressed. During the forming, the second forming surface moves in the pressing direction in which the metal material is pressed in the stage before the angular portion and the metal material come into contact with each other. In the stage before the angular portion and the metal material come into contact with each other, the hardening is not completed at the spot corresponding to the corner portion, and the spot is in a state of being easily deformed. Therefore, the second forming surface can deeply bite into the spot corresponding to the corner portion of the metal material before the hardening. Accordingly, the size of the round diameter (corner R) of the corner portion of the formed product can be made smaller than the size determined by the characteristics of the material and the forming conditions. From the above, the round diameter of the corner portion of the formed product can be reduced.

The forming die may include a first die which includes the first forming surface and is restricted in movement during the forming, and a second die which includes the second forming surface and is movable relative to the first die. In this case, during the forming, the second die is movable in the pressing direction with respect to the first die which is restricted in movement. Accordingly, the second forming surface can move in the pressing direction with respect to the first forming surface and bite into the corner portion of the metal material.

The forming die may include a pair of the second dies on both sides across the metal material. In this case, the forming die can reduce the round diameter of the corner portions on both sides of the metal material.

The forming die may include a first main die and a second main die that include the first forming surface and face each other, a first double-acting die that includes the second forming surface and is movable relative to the first main die, and a second double-acting die that includes the second forming surface and is movable relative to the second main die. In this case, it is possible to reduce the round diameter of the corner portion of the metal material while forming the flange portion on the metal material by the first main die and the second main die.

According to this forming method, it is possible to obtain the operation and effects having the same meaning as that of the above-described forming device.

During the forming, the second forming surface moves in the pressing direction in which the metal material is pressed in the stage before the hardening is performed at the spot corresponding to the corner portion of the metal material. In the stage before the hardening, the spot corresponding to the corner portion of the metal material is in a state of being easily deformed. Therefore, the second forming surface can deeply bite into the spot corresponding to the corner portion of the metal material before the hardening. Accordingly, the size of the round diameter (corner R) of the corner portion of the formed product can be made smaller than the size determined by the characteristics of the material and the forming conditions. From the above, the round diameter of the corner portion of the formed product can be reduced.

Hereinafter, preferred embodiments of the present invention will be described with reference to the drawings. In addition, in the respective drawings, the same portions or corresponding portions are designated by the same reference numerals, and duplicate descriptions will be omitted.

FIG. 1 is a schematic diagram of a forming device 1 according to the present embodiment. As shown in FIG. 1, the forming device 1 is a device that forms a metal pipe (formed product) having a hollow shape by blow forming. In the present embodiment, the forming device 1 is installed on a horizontal plane. The forming device 1 includes a forming die 2, a drive mechanism 3, a holding unit 4, a heating unit 5, a fluid supply unit 6, a cooling unit 7, and a control unit 8. In addition, in the present specification, the metal pipe refers to a hollow article after the forming in the forming device 1 is completed, and a metal pipe material 40 (metal material) refers to a hollow article before the forming in the forming device 1 is completed. The metal pipe material 40 is a steel type pipe material that can be hardened. Additionally, in the horizontal direction, a direction in which the metal pipe material 40 extends during forming may be referred to as a "longitudinal direction", and a direction perpendicular to the longitudinal direction may be referred to as a "width direction".

The forming die 2 is a die that forms the metal pipe material 40 into a metal pipe, and includes a lower die 11 (first die) and an upper die 12 (second die) that face each other in the vertical direction. The lower die 11 and the upper die 12 are made of steel blocks. The lower die 11 is fixed to a base stage 13 via a die holder or the like. The upper die 12 is fixed to a slide of the drive mechanism 3 via a die holder or the like.

The drive mechanism 3 is a mechanism that moves at least one of the lower die 11 and the upper die 12. In FIG. 1, the drive mechanism 3 has a configuration in which only the upper die 12 is moved. The drive mechanism 3 includes a slide 21 that moves the upper die 12 such that the lower die 11 and the upper die 12 are joined together, and a pull-back cylinder 22 serving as an actuator that generates a force for pulling the slide 21 upward, a main cylinder 23 serving as a drive source that downward-pressurizes the slide 21, and a drive source 24 that applies a driving force to the main cylinder 23.

The holding unit 4 is a mechanism that holds the metal pipe material 40 disposed between the lower die 11 and the upper die 12. The holding unit 4 includes a lower electrode 26 and an upper electrode 27 that hold the metal pipe material 40 on one end side in the longitudinal direction of the forming die 2, and a lower electrode 26 and an upper electrode 27 that holds the metal pipe material 40 on the other end side in the longitudinal direction of the forming die 2. The lower electrodes 26 and the upper electrodes 27 on both sides in the longitudinal direction hold the metal pipe material 40 by sandwiching the vicinity of an end portion of the metal pipe material 40 from the vertical direction. In addition, groove portions having a shape corresponding to an outer peripheral surface of the metal pipe material 40 are formed on an upper surface of the lower electrode 26 and a lower surface of the upper electrode 27. The lower electrode 26 and the upper electrode 27 are provided with drive mechanisms (not shown) and are movable independently in the vertical direction.

The heating unit 5 heats the metal pipe material 40. The heating unit 5 is a mechanism that heats the metal pipe material 40 by energizing the metal pipe material 40. The heating unit 5 heats the metal pipe material 40 in a state where the metal pipe material 40 is spaced apart from the lower die 11 and the upper die 12 between the lower die 11 and the upper die 12. The heating unit 5 includes the lower electrodes 26 and the upper electrodes 27 on both sides in the longitudinal direction described above, and a power supply 28 that allows an electric current to flow to the metal pipe material through the electrodes 26 and 27. In addition, the heating unit may be disposed in the previous process of the forming device 1 and performs heating externally.

The fluid supply unit 6 is a mechanism that supplies a high-pressure fluid into the metal pipe material 40 held between the lower die 11 and the upper die 12. The fluid supply unit 6 supplies the high-pressure fluid to the metal pipe material 40 that has been brought into a high-temperature state by being heated by the heating unit 5, and expands the metal pipe material 40. The fluid supply unit 6 is provided on both end sides of the forming die 2 in the longitudinal direction. The fluid supply unit 6 includes a nozzle 31 that supplies fluid from an opening of an end portion of the metal pipe material 40 to the inside of the metal pipe material 40, and a drive mechanism 32 that moves the nozzle 31 forward and backward with respect to the opening of the metal pipe material 40, and a supply source 33 that supplies the high-pressure fluid into the metal pipe material 40 via the nozzle 31. In the drive mechanism 32, the nozzle 31 is brought into close contact with the end portion of the metal pipe material 40 in a state where the sealing performance is secured during fluid supply and exhaust (refer to FIG. 2), and at other times, the nozzle 31 is spaced apart from the end portion of the metal pipe material 40. In addition, the fluid supply unit 6 may supply a gas such as high-pressure air or an inert gas as the fluid. Additionally, the fluid supply unit 6 may be the same device including the heating unit 5 together with the holding unit 4 having a mechanism that moves the metal pipe material 40 in the vertical direction.

Figure 2:
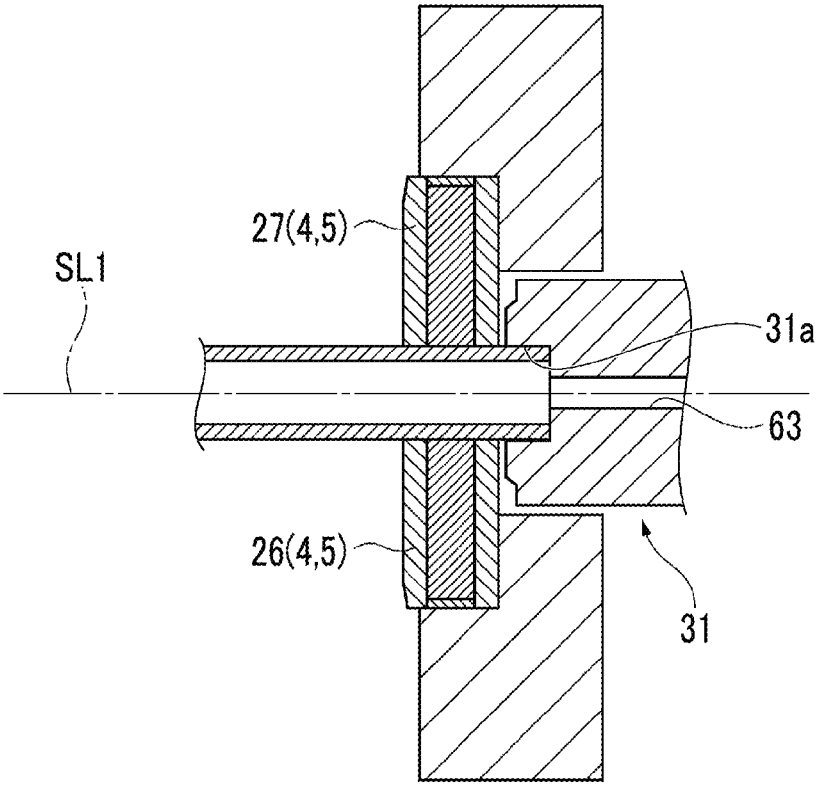
FIG. 2 is a cross-sectional view showing an aspect when a nozzle has sealed a metal pipe material.

FIG. 2 is a cross-sectional view showing an aspect when the nozzle 31 seals the metal pipe material 40. As shown in FIG. 2, the nozzle 31 is a cylindrical member into which the end portion of the metal pipe material 40 is insertable. The nozzle 31 is supported by the drive mechanism 32 such that a center line of the nozzle 31 coincides with a reference line SL1. The inner diameter of a feed port 31*a* of an end portion of the nozzle 31 on the metal pipe material 40 side substantially coincides with the outer diameter of the metal pipe material 40 after expansion forming. In this state, the nozzle 31 supplies the high-pressure fluid from an internal flow path 63 to the metal pipe material 40.

Returning to FIG. 1, the cooling unit 7 is a mechanism that cools the forming die 2. By cooling the forming die 2, the cooling unit 7 can rapidly cool the metal pipe material 40 when the expanded metal pipe material 40 has come into contact with a forming surface of the forming die 2. The cooling unit 7 includes a flow path 36 formed inside the lower die 11 and the upper die 12, and a water circulation mechanism 37 that supplies and circulates cooling water to the flow path 36.

The control unit 8 is a device that controls the entire forming device 1. The control unit 8 controls the drive mechanism 3, the holding unit 4, the heating unit 5, the fluid supply unit 6, and the cooling unit 7. The control unit 8 repeatedly performs an operation of forming the metal pipe material 40 with the forming die 2.

Specifically, the control unit 8 controls, for example, the transport timing from a transport device such as a robot arm to dispose the metal pipe material 40 between the lower die 11 and the upper die 12 in an open state. Alternatively, the control unit 8 may wait for a worker to manually dispose the metal pipe material 40 between the lower die 11 and the upper die 12. Additionally, the control unit 8 supports the metal pipe material 40 with the lower electrodes 26 on both sides in the longitudinal direction, and then controls the actuator of the holding unit 4 so as to lower the upper electrode 27 to sandwich the metal pipe material 40. Additionally, the control unit 8 controls the heating unit 5 to energize and heat the metal pipe material 40. Accordingly, an axial electric current flows through the metal pipe material 40, and the electric resistance of the metal pipe material 40 itself causes the metal pipe material 40 itself to generate heat due to Joule heat.

The control unit 8 controls the drive mechanism 3 to lower the upper die 12 and bring the upper die 12 closer to the lower die 11 to close the forming die 2. On the other hand, the control unit 8 controls the fluid supply unit 6 to seal the openings of both ends of the metal pipe material 40 with the nozzle 31 and supply the fluid. Accordingly, the metal pipe material 40 softened by heating expands and comes into contact with the forming surface of the forming die 2. Then, the metal pipe material 40 is formed so as to follow the shape of the forming surface of the forming die 2. When the metal pipe material 40 comes into contact with the forming surface, hardening of the metal pipe material 40 is performed by being quenched with the forming die 2 cooled by the cooling unit 7.

Figure 3A:
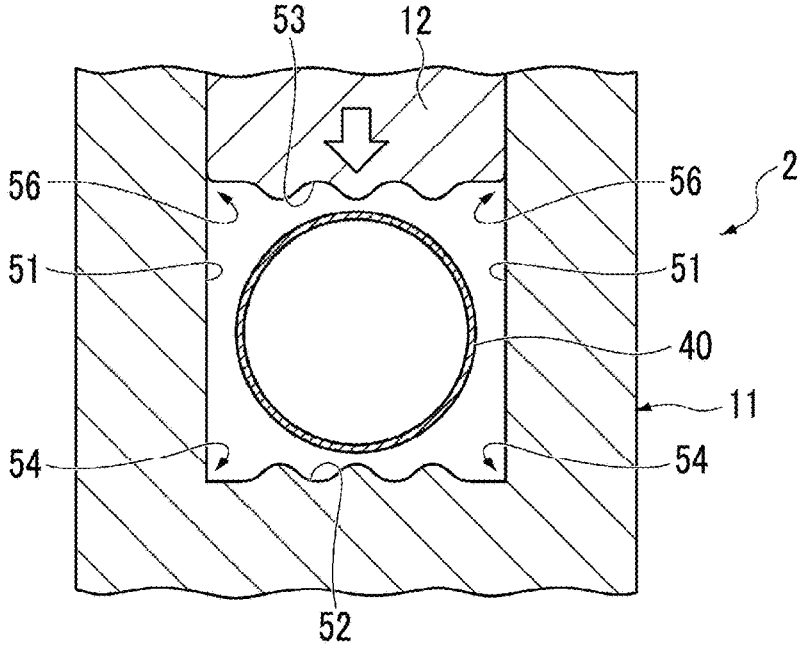
FIGS. 3A to 3C are cross-sectional views of a forming die.
Figure 3B:
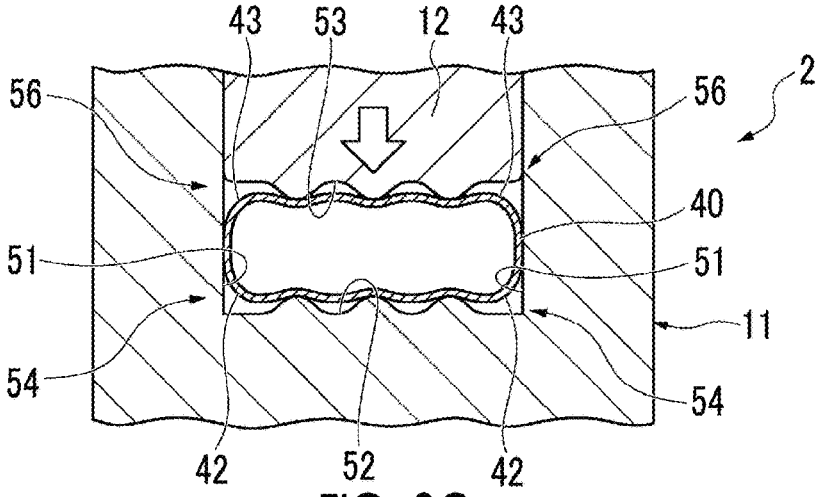
Figure 3C:
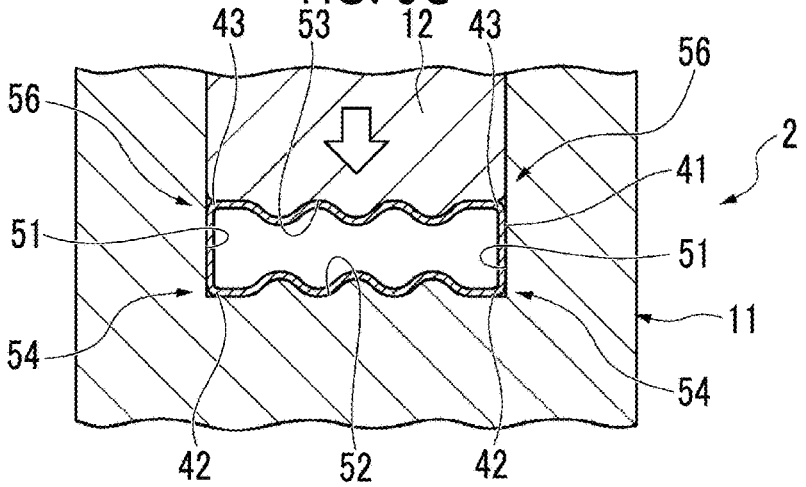

A detailed configuration of the forming die 2 of the forming device 1 and a forming procedure will be described with reference to FIGS. 3A to 3C. As shown in FIG. 3A, in a cross-sectional view (as viewed from the longitudinal direction of the metal pipe material 40), the forming die 2 has a pair of lateral forming surfaces 51 (first forming surfaces) that spreads in the vertical direction on a lateral side, a lower forming surface 52 that spreads in a lateral direction on a lower side, and an upper forming surface 53 (second forming surface) that spreads in the lateral direction on an upper side. Accordingly, in the cross-sectional view, the forming die 2 has angular portions 54 formed by the lateral forming surfaces 51 and the lower forming surface 52 that intersect (here, orthogonal to) each other, and angular portions 56 formed by the lateral forming surfaces 51 and the upper forming surface 53. In addition, in the present embodiment, the lower forming surface 52 and the upper forming surface 53 have a waveform shape. Accordingly, a lower surface and an upper surface of the metal pipe 41 (FIG. 3C) have a waveform for reinforcement.

The die 11 is a die which is restricted in movement during the forming. The die 11 is not connected to the drive mechanism 3 or the like and is fixed to the base stage 13. Therefore, the die 11 is in a state where the movement is restricted so as not to move. The die 11 has a recessed shape in the cross-sectional view. Therefore, the die 11 has the lateral forming surfaces 51 constituted by a pair of side surfaces on an internal space side and the lower forming surface 52 constituted by a bottom surface on the internal space side.

The die 12 is a die that is relatively movable with respect to the die 11. As described above, the die 12 is movable in the vertical direction by the driving force of the drive mechanism 3. The die 12 has the upper forming surface 53 constituted by a lower surface on the internal space side. By virtue of such a configuration, the upper forming surface 53 is relatively movable with respect to the lateral forming surface 51.

The die 12 is provided between the pair of lateral forming surfaces 51 of the die 11. Each lateral forming surface 51 extends further upward even in a spot not used for the forming. The die 12 is movable in the vertical direction so as to be guided by the spot. The side surfaces on both sides of the die 12 are disposed so as to be substantially in contact with the pair of lateral forming surfaces 51 of the die 11, and move in the vertical direction along the lateral forming surfaces 51. Additionally, the upper forming surface 53 of the die 12 spreads over the entire region in the lateral direction between the pair of lateral forming surfaces 51.

During the forming, the upper forming surface 53 moves in a pressing direction (here, downward) for pressing the metal pipe material 40 in the stage before the angular portion 56 and the metal pipe material 40 come into contact with each other. The upper forming surface 53 moves downward so as to compress the metal pipe material 40 when the high-pressure fluid is supplied from the fluid supply unit 6 to the heated metal material and the blow forming is performed. In addition, the stage before the angular portion 56 and the metal pipe material 40 come into contact with each other is a stage before the spot of the metal pipe material 40 corresponding to the corner portion 43 comes into contact with the angular portion 56. In this stage, since the spot corresponding to the corner portion 43 is not in contact with the forming die 2 (for example, refer to FIG. 3B), the hardening is not completed and the spot is in a state of being easily deformed. In addition, in the present specification, the angular portion 56 refers to a narrow range of about 5.0 mm from an intersection point between the lateral forming surface 51 and the upper forming surface 53. Therefore, in FIG. 3B, a part of the metal pipe material 40 is in contact with the lateral forming surface 51 and the upper forming surface 53. However, this state is not applicable to a state in which the metal pipe material 40 has come into contact with the angular portion 56.

From the above-described relationship, the upper forming surface 53 moves as follows during the forming. That is, in the stage before the hardening is performed on the spot corresponding to the corner portion 43 of the metal pipe material 40, the upper forming surface 53 moves in the pressing direction in which the metal pipe material 40 is pressed, thereby forming the corner portion 43 in the metal pipe material 40. In addition, when the corner portion 43 is formed on the metal pipe material 40, the corner portion 43 is in a state of having coming into contact with the forming die. Therefore, the hardening is performed on the corner portion 43.

As shown in FIG. 3A, when the metal pipe material 40 is disposed in an internal space of the die 11, the control unit 8 lowers the die 12 downward so as to insert the die 12 into the internal space of the die 11. Next, the control unit 8 performs the blow forming by supplying the fluid to the metal pipe material 40 by the fluid supply unit 6 while lowering the die 12 downward. Accordingly, as shown in FIG. 3B, the metal pipe material 40 expands and a part of the metal pipe material 40 comes into contact with the forming surfaces 51, 52, and 53. Accordingly, the metal pipe material 40 is deformed into a shape corresponding to each of the forming surfaces 51, 52, and 53. The control unit 8 continuously supplies the fluid to the metal pipe material 40 by the fluid supply unit 6, and further lowers the die 12 downward. Accordingly, as shown in FIG. 3C, the metal pipe material 40 has a shape along each of the forming surfaces 51, 52, and 53, and the metal pipe 41 is completed. In addition, the control unit 8 increases the pressure of the fluid supply unit 6 at a predetermined timing before the completion to perform finish forming.

Next, the operation and effects of the forming device 1 according to the present embodiment will be described.

The forming die 2 of the forming device 1 has the angular portion 56 formed by the lateral forming surface 51 and the upper forming surface 53 that intersect each other in the cross-sectional view. Therefore, during the forming, the metal pipe material 40 is deformed along the angular portion 56 of the forming die 2 to have a shape having the corner portion 43.

Figure 4A:
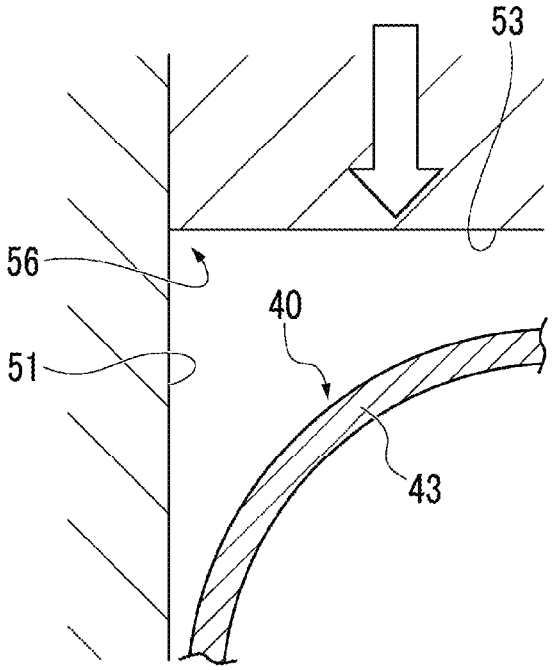
FIGS. 4A to 4D are enlarged views showing aspects of an angular portion of the forming die.
Figure 4B:
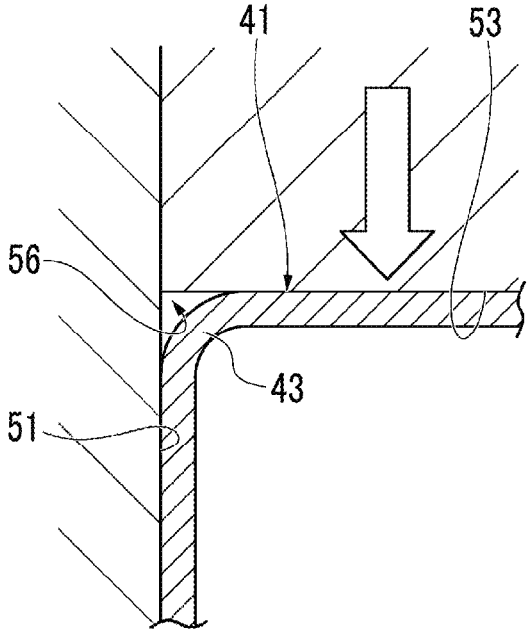
Figure 4C:
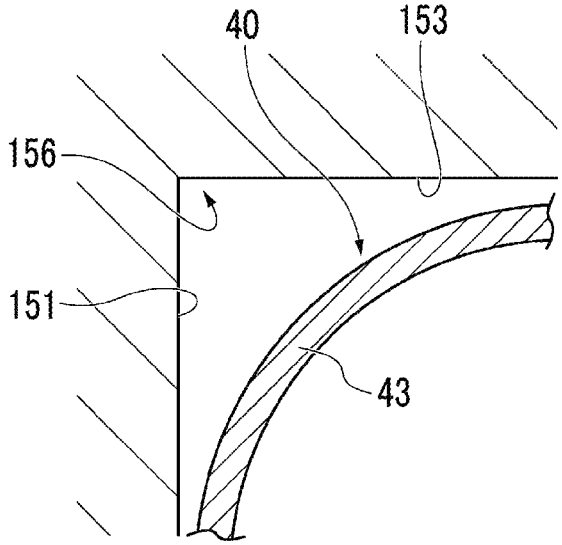
Figure 4D:
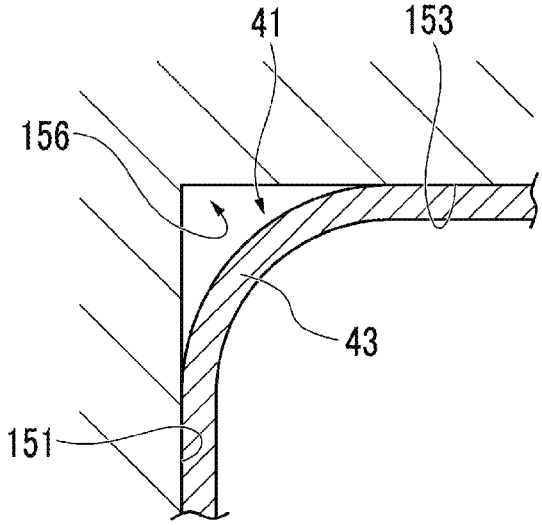

Here, a forming die of a forming device according to a comparative example will be described with reference to FIGS. 4C and 4D. In the forming die of the forming device according to the comparative example, the lateral forming surface 151 and the upper forming surface 153 forming the angular portion 156 are constituted by one die without moving relative to each other. In this case, since the size of the round diameter (corner R) of the corner portion 43 of the metal pipe 41 is substantially uniquely determined by the characteristics of the material and the forming conditions, there was a problem that it was difficult to reduce the diameter of the round diameter. That is, there was a problem that the round diameter of the corner portion 43 cannot be made smaller than in the state shown in FIG. 4D.

In contrast, in the forming die 2 of the forming device 1 according to the present embodiment, the upper forming surface 53 is relatively movable with respect to the lateral forming surface 51. That is, the upper forming surface 53, which is one surface forming the angular portion 56, is movable in the pressing direction in which the metal pipe material 40 is pressed. As shown in FIG. 4A, during the forming, the upper forming surface 53 moves in the pressing direction in which the metal pipe material 40 is pressed in the stage before the angular portion 56 and the metal pipe material 40 come into contact with each other. In the stage before the angular portion 56 and the metal pipe material 40 come into contact with each other, the hardening is not completed at the spot corresponding to the corner portion 43, and the spot is in a state of being easily deformed. Therefore, the upper forming surface 53 can deeply bite into the spot corresponding to the corner portion 43 of the metal pipe material 40 before the hardening. Accordingly, as shown in FIG. 4B, the size of the round diameter (corner R) of the corner portion 43 of the metal pipe 41 can be made smaller than the size determined by the characteristics of the material and the forming conditions. From the above, the round diameter of the corner portion of the formed product can be reduced.

The forming die 2 has the die 11 which has the lateral forming surface 51 and is restricted in movement during the forming, and the die 12 which has the upper forming surface 53 and is relatively movable with respect to the die 11. In this case, during the forming, the die 12 is movable in the pressing direction with respect to the die 11 which is restricted in movement. Accordingly, the upper forming surface 53 can move in the pressing direction with respect to the lateral forming surface 51 and bite into the corner portion 43 of the metal pipe material 40.

The forming method is a forming method in which a heated metal pipe material 40 by a forming die 2, the forming die 2 has an angular portion 56 formed by an upper forming surface 53 and a lateral forming surface 51 that intersect each other in a cross-sectional view, the upper forming surface 53 is relatively movable with respect to the lateral forming surface 51, the upper forming surface 53 is moved in a pressing direction in which the metal pipe material 40 is pressed in a stage before the angular portion 56 and the metal pipe material 40 come into contact with each other during the forming.

According to this forming method, it is possible to obtain the operation and effects having the same meaning as that of the above-described forming device 1.

Additionally, during the forming, the corner portion 43 is formed in the metal pipe material 40 by moving the upper forming surface 53 in a pressing direction in which the metal pipe material 40 is pressed in a stage before the hardening is performed at a spot corresponding to the corner portion 43 of the metal pipe material 40. In the stage before the hardening, the spot corresponding to the corner portion 43 of the metal pipe material 40 is in a state of being easily deformed. Therefore, the upper forming surface 53 can deeply bite into the spot corresponding to the corner portion 43 of the metal pipe material 40 before the hardening. Accordingly, the size of the round diameter (corner R) of the corner portion 43 of the metal pipe 41 can be made smaller than the size determined by the characteristics of the material and the forming conditions. From the above, the round diameter of the corner portion 43 of the metal pipe 41 can be reduced.

The present invention is not limited to the above-described embodiment.

Figure 5A:
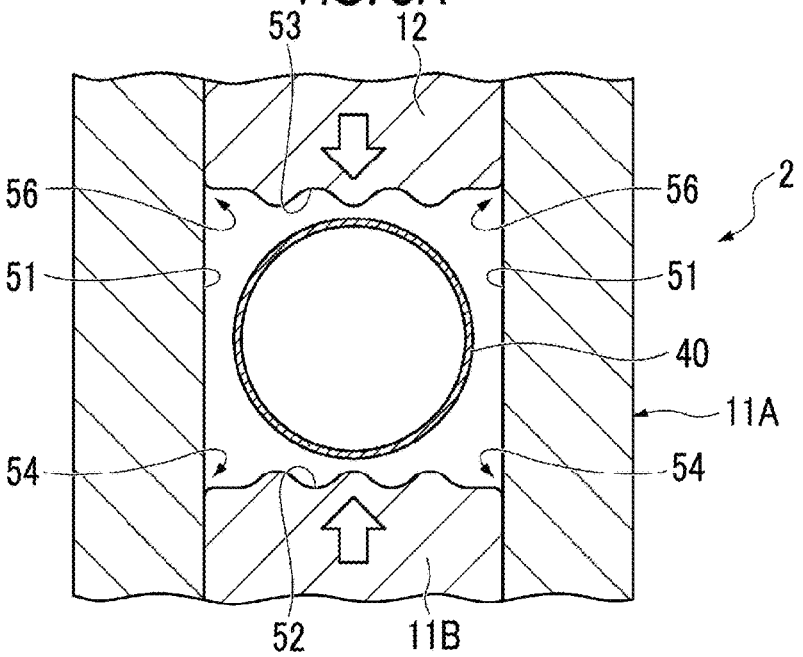
FIGS. 5A to 5C are cross-sectional views of a forming die of a forming device according to a modification example.
Figure 5B:
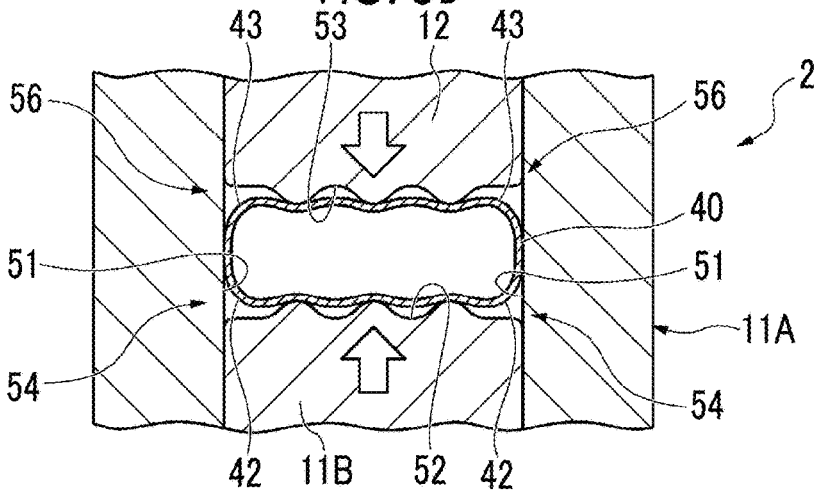
Figure 5C:
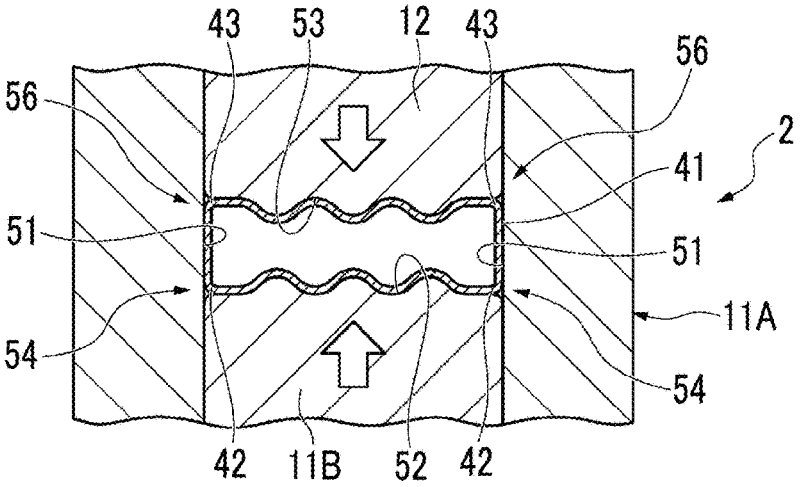

In the above-described embodiment, the upper forming surface 53 of the upper angular portion 56 is configured to be movable with respect to the lateral forming surface 51, whereas the lower forming surface 52 of the lower angular portion 54 is configured integrally with the lateral forming surface 51. Instead of this, as shown in FIGS. 5A to 5C, the lower forming surface 52 of the lower angular portion 54 may also be movable with respect to the lateral forming surface 51. Specifically, the die includes a main die 11A and a double-acting die 11B. The main die 11A is a die which has the lateral forming surface 51 and is restricted in movement during the forming. The double-acting die 11B is a die which has the lower forming surface 52 and is relatively movable with respect to the main die 11A. During the forming, the lower forming surface 52 moves in the pressing direction in which the metal pipe material 40 is pressed in the stage before the angular portion 54 and the metal pipe material 40 come into contact with each other. Here, the lower forming surface 52 moves upward as the pressing direction. In addition, the operation of the double-acting die 11B has the same meaning as that of the die 12 except that the lower forming surface 52 moves upward as the pressing direction. In this case, the forming die 2 is configured to have a pair of movable dies on both the upper and lower sides across the metal pipe material 40. Accordingly, the forming die 2 can reduce the round diameter of the corner portions 42 and 43 on both the upper and lower sides of the metal pipe material 40.

Figure 6A:
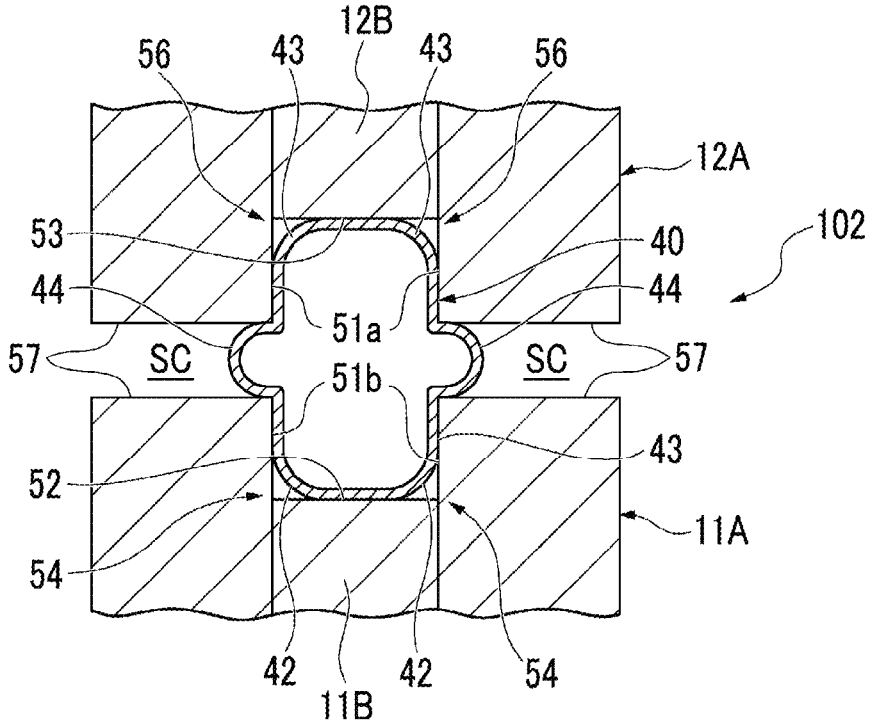
FIGS. 6A and 6B are cross-sectional views of a forming die of a forming device according to a modification example.
Figure 6B:
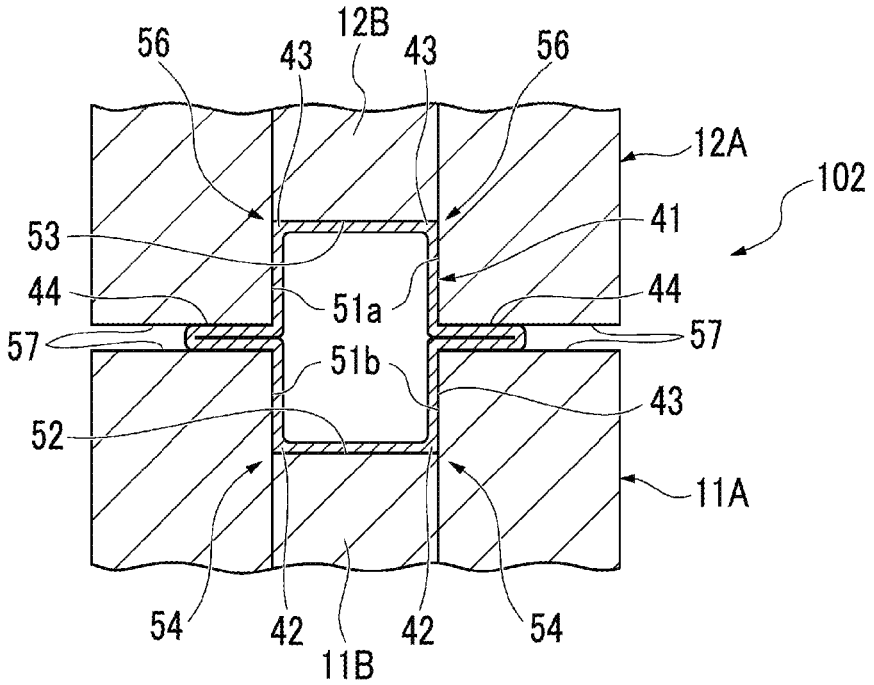

In the above-described embodiment and the modification example shown in FIGS. 5A to 5C, the die having the lateral forming surface 51 is a die which is restricted in movement during the forming. However, the configuration of the die having the lateral forming surface 51 is not particularly limited. For example, a forming die 102 as shown in FIGS. 6A and 6B may be adopted. The forming die 102 includes a main die 11A (first main die) that has a first lateral forming surface 51*a* and a main die 12A (second main die) that has a second lateral forming surface 51*b*, and the first lateral forming surface 51*a* and the second lateral forming surface 51*b* face each other, a double-acting die 11B (first double-acting die) that has a lower forming surface 52 and is relatively movable with respect to the main die 11A, and a double-acting die 12B (second double-acting die) that has an upper forming surface 53 and is relatively movable with respect to the main die 12A (second main die). The first lateral forming surface 51*a* and the second lateral forming surface 51*b* correspond to the first forming surfaces in the modification example shown in FIGS. 6A and 6B. The lower forming surface 52 and the upper forming surface 53 correspond to the second forming surfaces in the modification example shown in FIGS. 6A and 6B.

The main dies 11A and 12A function as flange forming surfaces 57 for forming a flange portion 44 with surfaces facing each other in the vertical direction. Therefore, a space between the flange forming surfaces 57 of the main dies 11A and 12A becomes a sub-cavity SC.

For example, as shown in FIG. 6A, the control unit 8 supplies the fluid to the metal pipe material 40 by the fluid supply unit 6, thereby causing a part of the metal pipe material 40 to enter the sub-cavity SC between the main dies 11A and 12A. In this case, the double-acting dies 11B and 12B are moved in the pressing direction. After that, the die closing is further performed, and as shown in FIG. 6B, the entering portion to the sub-cavity SC is crushed to form the flange portion 44. Additionally, the control unit 8 further presses the double-acting dies 11B and 12B, thereby reducing the round diameter of the corner portions 42 and 43. From the above, according to the modification example shown in FIGS. 6A and 6B, the round diameter of the corner portions 42 and 43 of the metal pipe 41 can be reduced while forming the flange portion 44 on the metal pipe 41 with the main dies 11A and 12A.

The shape of the formed product is not limited to that according to the above-described embodiment, and the present invention can be applied as long as the formed product has the corner portion. Additionally, in the above-described embodiment, the angular portions are constituted by the forming surfaces (angular portions having 90° forming surfaces) perpendicular to each other, but the angle of the angular portions is not particularly limited and can be changed appropriately.

In addition, in the above-described embodiment, the die adopted in the forming device for STAF has been described as an example. However, the type of the forming device in which the die according to the present invention is adopted is not particularly limited, and may be forming devices for hot stamping, other forming devices, or the like.

It should be understood that the invention is not limited to the above-described embodiment, but may be modified into various forms on the basis of the spirit of the invention. Additionally, the modifications are included in the scope of the invention.

What is claimed is:

1. A forming device that forms a metal pipe including a pipe portion and a flange portion, the forming device comprising:

a forming die configured to form a heated metal pipe, wherein the forming die includes a first main die, a first double-acting die that is movable relative to the first main die, and an angular portion formed by a first plane coincident with a first forming surface and a second plane coincident with a second forming surface that intersect each other in a cross-sectional view, the second forming surface is movable relative to the first forming surface, the first main die includes the first forming surface that forms the pipe portion and a flange forming surface that intersects with the first forming surface and forms the flange portion, the first double-acting die includes the second forming surface that forms the pipe portion, and a second main die that includes the first forming surface and faces the first main die, and a second double-acting die that includes the second forming surface and is movable relative to the second main die, and the flange forming surface of the first main die forms the flange portion, and the second forming surface is configured to move in a pressing direction in which the heated metal pipe material is pressed in a stage before the angular portion and the heated metal pipe material come into contact with each other.

2. The forming device according to claim 1, wherein the first forming surface and the second forming surface are orthogonal to each other.

3. The forming device according to claim 1, wherein the forming die further includes a second main die that includes the first forming surface and faces the first main die, and a second double-acting die that includes the second forming surface and is movable relative to the second main die.

4. The forming device according to claim 3, wherein the first main die and the second main die do not come into contact with each other during forming.

5. A forming method of forming a metal pipe including a pipe portion and a flange portion by forming a heated metal pipe material with a forming die, in which the forming die includes a first main die, a first double-acting die that is movable relative to the first main die, and an angular portion formed by a first plane coincident with a first forming surface and a second plane coincident with a second forming surface that intersect each other in a cross-sectional view, the second forming surface is movable relative to the first forming surface, the first main die includes the first forming surface that forms the pipe portion and a flange forming surface that intersects with the first forming surface and forms the flange portion, and the first double-acting die includes the second forming surface that forms the pipe portion, and a second main die that includes the first forming surface and faces the first main die, and a second double-acting die that includes the second forming surface and is movable relative to the second main die, the method comprising:

during the forming, forming the flange portion by the flange forming surface of the first main die, and moving the second forming surface in a pressing direction in which the heated metal pipe material is pressed in a stage before the angular portion and the heated metal pipe material come into contact with each other.

6. A forming device that forms a metal pipe including a pipe portion and a flange portion, the forming device comprising:

a forming die configured to form a heated metal pipe material, wherein the forming die includes a first main die, a first double-acting die that is movable relative to the first main die, and an angular portion formed by a first plane coincident with a first forming surface and a second plane coincident with a second forming surface that intersect each other in a cross-sectional view, the second forming surface is movable relative to the first forming surface, the first main die includes the first forming surface that forms the pipe portion and a flange forming surface that intersects with the first forming surface and forms the flange portion, the first double-acting die includes the second forming surface that forms the pipe portion, and the flange forming surface of the first main die forms the flange portion, and the second forming surface is configured to move in a pressing direction during forming in which the heated metal pipe material is pressed, thereby forming a corner portion on the heated metal pipe material, in a stage before hardening may be performed by the angular portion at a spot corresponding to the corner portion of the heated metal pipe material, and a second main die that includes the first forming surface and faces the first main die, and a second double-acting die that includes the second forming surface and is movable relative to the second main die.

7. The forming device according to claim 3, wherein the first double-acting die and the second double-acting die are configured to move in the pressing direction in a state where the first main die and the second main die are closed to form the flange portion, such that the angular portion and the pipe portion come into contact with each other.

* * * * *